US007790224B2

(12) United States Patent
Eberle et al.

(10) Patent No.: US 7,790,224 B2
(45) Date of Patent: Sep. 7, 2010

(54) METHOD FOR SINTER COATING

(75) Inventors: Jürgen Eberle, Blaustein (DE); Dirk Heinrich, Herten (DE); Thomas Schiffer, Haltern (DE); Hermann Stegmaier, Böbingen/Rems (DE); Hans-Joachim Wönicker, Stuttgart (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 733 days.

(21) Appl. No.: 10/557,393

(22) PCT Filed: May 19, 2004

(86) PCT No.: PCT/EP2004/005442

§ 371 (c)(1),
(2), (4) Date: Jun. 30, 2006

(87) PCT Pub. No.: WO2004/103579

PCT Pub. Date: Dec. 2, 2004

(65) Prior Publication Data

US 2007/0062616 A1 Mar. 22, 2007

(30) Foreign Application Priority Data

May 20, 2003 (DE) ..... 103 22 678

(51) Int. Cl.
*B05D 1/20* (2006.01)
*B05C 19/02* (2006.01)

(52) U.S. Cl. ..... 427/185; 427/459; 427/314; 118/309; 118/634

(58) Field of Classification Search ..... 427/459, 427/185, 314; 118/309, 634
See application file for complete search history.

(56) References Cited

U.S. PATENT DOCUMENTS

| | | | | |
|---|---|---|---|---|
| 2,974,060 | A * | 3/1961 | Dettling | 427/185 |
| 3,028,251 | A * | 4/1962 | Nagel | 427/185 |
| 3,479,200 | A * | 11/1969 | Estabrooks | 427/101 |
| 5,888,372 | A * | 3/1999 | Bollens et al. | 205/159 |
| 5,891,515 | A * | 4/1999 | Dutheil et al. | 427/185 |
| 6,537,610 | B1 * | 3/2003 | Springer et al. | 427/185 |

OTHER PUBLICATIONS

International Search Report PCT/EP2004/005442.

* cited by examiner

*Primary Examiner*—Frederick J Parker
(74) *Attorney, Agent, or Firm*—James E. Howard; Andre Pallapies

(57) ABSTRACT

A method for sinter coating a work-piece is disclosed, the work-piece having at least two sections of different surface-related heat capacities. The method includes a first step of pre-heating the work-piece to a first temperature that is higher than a fusion temperature of a sinter coating material. The method also includes a step of rapidly heating of the work-piece to a second temperature that is higher than the first temperature. However, the rapid heating step is halted before the temperature of the work-piece section with the greater surface-related heat capacity matches the second temperature. The work-piece then has a subsequent step of application of the sinter material to the work-piece. The step of shock heating of the work-piece is preceded by a step of pre-heating the work-piece under conditions which, with continuing effect on the work-piece, bring the work-piece under conditions which, with continuing effect on the work-piece, bring the work-piece to a second temperature between the fusion temperature of the sinter material and the first temperature.

18 Claims, 2 Drawing Sheets

METHOD FOR SINTER COATING

BACKGROUND OF THE INVENTION

The invention relates to a method for the sinter coating of a workpiece and a device suitable for carrying out the method.

Methods for producing protective coatings on metal surfaces, especially wire goods and small metal parts, by sintering-on plastic powder have been known for a long time and are in use. For carrying out such methods, suitable plastic powders are supplied, for example, by DEGUSSA AG, Marl under the trade name VESTOSINT.

The sinter coating of a workpiece conventionally takes place by first heating the workpiece to a temperature above the fusion temperature of the material to be sintered-on and then bringing the workpiece in contact with the material, generally in powder form. Contact takes place at ambient temperatures which must necessarily lie below the fusion temperature of the sinter material so that the workpiece loses heat during contact with the sinter material and finally falls below the fusion temperature of the sinter material whereby the sinter process comes to a standstill. The thickness of the layer deposited up till then on the workpiece is proportional to the time interval between the beginning of contact with the sinter material and the time at which the temperature falls below its fusion temperature. If the workpiece to be coated has a small material thickness, the cooling takes place more rapidly than in the case of a workpiece having a greater material thickness so that in order to achieve uniform layer thicknesses on workpieces having different material thicknesses, the temperatures to which the workpieces are heated before they are brought in contact with the sinter material must be different. In the case of simply shaped workpieces having a homogeneous material composition and uniform wall thickness, sinter coatings having a desired coating thickness can thus be achieved by a suitable choice of temperature at which workpieces are brought in contact with the sinter material.

In the case of a workpiece having a non-uniform wall thickness or inhomogeneous material composition, in general terms workpieces comprising sections having different surface-related heat capacity, this results in the problem that the sinter layers which are deposited on a section of higher surface-related heat capacity before this is cooled below the fusion temperature of the sinter material, are larger than those in a section having lower surface-related heat capacity. It is therefore difficult to provide such workpieces with a coating of uniform thickness. If a minimum layer thickness must be achieved on the sections having low surface-related heat capacity, it must be accepted that the resulting layer on other sections will be thicker. This not only results in undesirable increased costs because of the unnecessary consumption of sinter material but the different layer thicknesses also increase the probability of defects of the sinter layer which impair their protective effect for the workpiece located thereunder.

Rapid heating methods have been proposed to solve this problem wherein the heating of the workpiece is interrupted before workpiece has reached a homogeneous temperature distribution. This has the result that when brought in contact with the sinter material, sections of the workpiece having a low surface-related heat capacity have a higher temperature than those having a low surface-related heat capacity so that the time intervals before cooling below the fusion temperature and thus the resulting layer thicknesses for both sections become approximately the same. In principle it should be assumed that with such a method, by suitably selecting the heating conditions, i.e. the final temperature which would be established on a workpiece if it were continuously exposed to the rapid heating conditions and the time interval in which the workpiece is exposed to the rapid heating, temperature differences between sections of different heat capacity can be adjusted within certain upper limits and can be optimised to the same deposition layer thicknesses. However, it has been found in tests that no satisfactory layer qualities could be achieved in this way and that in particular in transition zones between sections having different surface-related heat capacities, there was a strong tendency towards layer defects.

SUMMARY OF THE INVENTION

It is thus the object of the invention to provide a method and a device which allow sinter layers of high quality and homogeneous thickness to be produced on workpieces having sections with different surface-related heat capacities.

It has surprisingly been found that this aim can be achieved if the conventional rapid heating is preceded by a step of pre-heating the workpiece, wherein the pre-heating conditions are selected so that, if the pre-heating conditions were continued indefinitely, they would bring the workpiece up to a temperature which lies between the fusion temperature of the coating material and that temperature which the workpiece would reach if it were continuously exposed to the rapid heating conditions.

It is postulated that the efficiency of the method is based on the fact that the strong temperature gradient present in conventional rapid heating between the surface and the interior of a section having a high surface-related heat capacity is reduced by the pre-heating step and that as a result, the importance of the internal temperature compensation inside the workpiece for the cooling of its surface is reduced. Whereas in simple rapid heating without pre-heating, deep surface regions of the workpiece, especially at a boundary between sections of different surface-related heat capacity, absorb comparatively little heat because of their protected position and accordingly cool rapidly during coating. In the method according to the invention these areas retain a temperature suitable for sintering-on for longer as a result of the pre-heating so that a good-quality layer is also formed in these problem zones.

Both the pre-heating and also the rapid heating preferably take place by inserting the workpiece into respective thermal baths, for instance, in the form of furnaces. In this case, the residence time of the workpiece in the preheating thermal bath is preferably longer than the residence in the rapid heating thermal bath. In a coating installation, these different residence times are preferably achieved by making the length of the pre-heating furnace along a conveying section for the workpieces to be coated greater than a length of the furnace for the rapid heating.

If the workpiece cools slowly during the sintering, in a final phase a rough surface can form as a result of incomplete fusion of the sinter material. In order to improve the surface quality, after applying the sinter material it is appropriate to after-heat the workpiece at least superficially to the fusion temperature of the coating material in order to thus achieve a smoothing of the surface.

The sinter material is preferably applied to the workpiece by introducing the heated workpiece into the sinter material in the fluidised state.

A polyamide powder such as the VESTOSINT powder already mentioned is suitable as sinter material. This has a melting point of 176° C.; thus a temperature of the pre-heating thermal bath between 240 and 340° C. is suitable for pre-heating; and a temperature of the rapid heating thermal bath between 390 and 420° C. is preferred for rapid heating.

The rapid heating is appropriately interrupted when the section having the higher surface-related heat capacity has reached an average temperature selected in a range between 300 and 370° C. The specifically selected temperature depends on the ratio of the surface-related heat capacities; the more different these are, the lower the selected interruption temperature must be in order to ensure the same layer thickness on the different sections of the workpiece.

A preferred application of the method according to the invention is the coating of a heat exchanger, especially a condenser for a refrigerator where the section having high surface-related heat capacity is a pipe for a heat transfer fluid and the section having low surface-related heat capacity is a wire affixed to the pipe.

BRIEF DESCRIPTION OF THE DRAWINGS

Further features and advantages of the method according to the invention are obtained from the following description of an exemplary embodiment with reference to the appended figures. In the figures:

FIG. 1 is a perspective view of a section of a condenser known per se in a wire-pipe design for a refrigerator on which the coating method according to the invention can be advantageously applied. Such a condenser is substantially constructed of two different types of elements, a zigzag-shaped bent steel pipe 1 and a plurality of wires 2, each disposed transversely to the rectilinear sections of the steel pipe 1 and connecting these on to the other. The wires 2 are thus used at the same time to stiffen the condenser and also to enlarge its heat-exchange surface.

Figure 1:
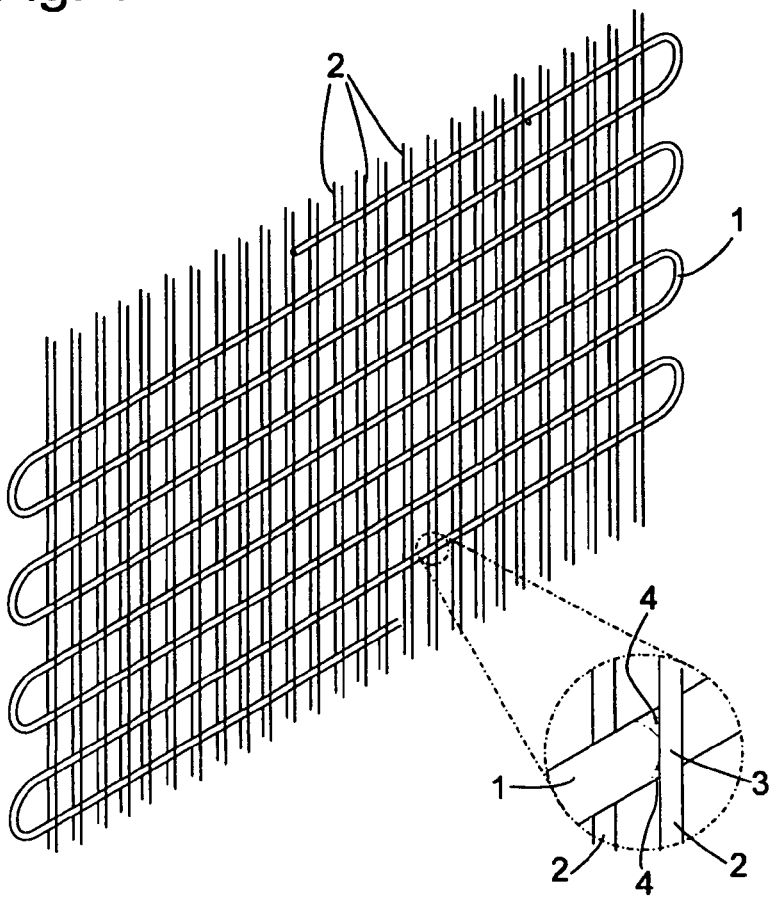
FIG. 1 is a heat exchanger as an example for a workpiece on which the method can be implemented.

The steel pipe 1 typically has an outside diameter of 8 mm and a wall thickness of 1 mm. The wires 2 are solid with a typical diameter of 1.6 mm. The wires 2 are fixed to the steel pipe 1 by spot welding, soldering or other suitable techniques wherein in the contact zone 3 between pipe 1 and wire 2, narrow barely accessible corners 4 are formed.

As can easily be seen, the quantity of material per unit surface area at the pipe 1 is significantly larger than at the wires 2 and specifically with the dimensions selected here a factor of about 2.5 larger. Accordingly, the heat capacity per unit surface area at the wires 2 is significantly lower than that at the pipe 1 so that the former are heated significantly more rapidly than the latter in a thermal bath.

Figure 2:
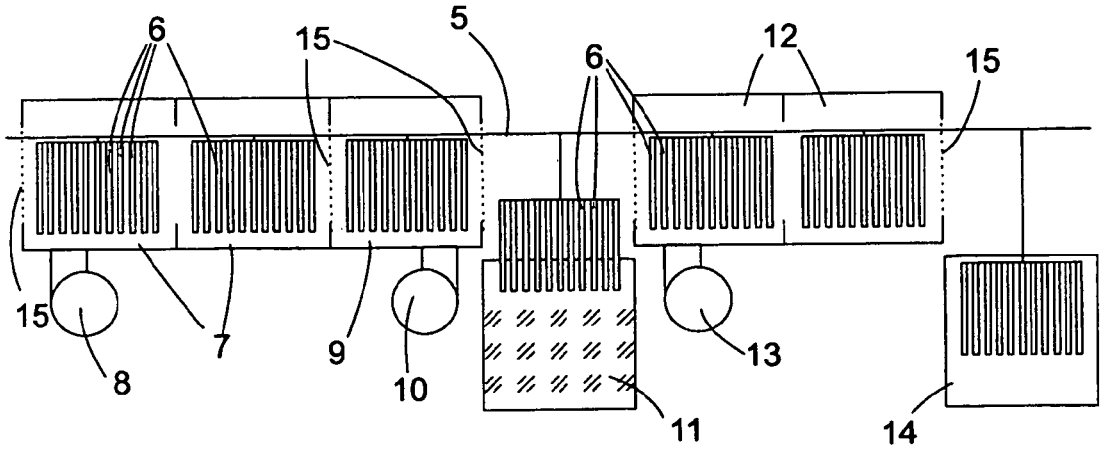
FIG. 2 is a block diagram of an installation for carrying out the method.

The coating device, which is shown highly schematically in FIG. 2, comprises a conveying device 5 to which respectively groups of several heat exchangers 6 can be affixed. The groups of heat exchangers 6 are conveyed through the coating device by step-wise movements of the conveying device 5 wherein the time intervals between successive conveying steps can, for example, be 20 to 40 s.

On their path through the coating device, the heat exchangers 6 initially pass through a pre-heating furnace 7 which is held by a pre-heating burner 8 at a fixed temperature between 200 and 340° C., in this case at 240° C. The length of the pre-heating furnace 7 is selected to that two groups of heat exchangers fit in or two conveying steps are required to convey one group through the pre-heating furnace 7.

Directly adjacent to the pre-heating furnace 7 is a rapid heating furnace 9 which is held at a temperature specified between 390 and 420° C. by a further burner 10. The two furnaces 7, 9 can be delimited from one another by a lock 15 indicated by a dashed line in the figure; however, this is not absolutely necessary. The rapid heating furnace 9 provides space for a group of heat exchangers 6; their residence time in the furnace 9 thus corresponds to the time interval between two conveying steps of the conveying device 5.

Provided adjacent to the rapid heating furnace 9 is a fluidised bed 11 containing fluidised polyamide powder. The conveying device 5 has control elements (not shown) for lowering a group of heat exchangers 6 into the fluidised bed 11 and raising the group again. The fluidised bed 11 provides space for a group of heat exchangers 6 so that the maximum residence time of the heat exchanges therein corresponds to the time interval between two conveying steps of the conveying device 5. However, the actual residence time in the fluidised bed 11 can be arbitrarily shortened in contrast by raising the heat exchangers 6 from the fluidised bed 11 at a time which can be arbitrarily selected in principle between two conveying steps of the conveying device 5.

The heat exchangers 6 provided with a polyamide coating in the fluidised bed 11 finally reach an after-heating furnace 12 wherein they are again heated to a temperature above the fusion temperature of the polyamide powder. For this purpose the after-heating furnace 12 is held at a temperature of 240° C. by a burner 13. This after-heating furnace 12 is used to improve the quality of the polyamide layers deposited on the heat exchangers 6. These can have a certain roughness on leaving the fluidised bed 11 which can be attributed to the fact that towards the end of the deposition of the sinter material on the heat exchangers, their temperature can have dropped to such an extent that this is no longer sufficient for complete fusion of the sinter material grains. The after-heating furnace 12 provides space for two groups of heat exchangers 6 so that two steps of the conveying device 3 are required to convey the heat exchangers 6 through the after-heating furnace 12.

Provided adjacent to the after-heating furnace 12 is a dipping tank 14 wherein the ready-coated heat exchangers 6 are quenched.

Figure 3:
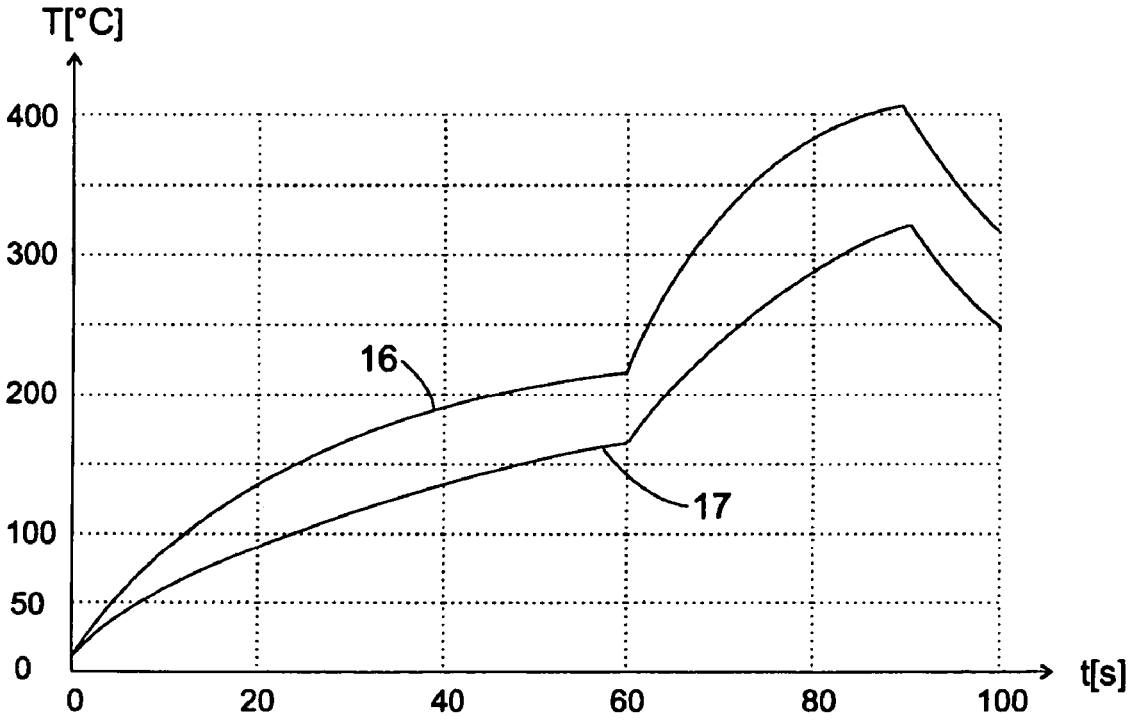
FIG. 3 shows the surface temperatures of the condenser as a function of time during heating according to the method according to the invention.

FIG. 3 shows the time behaviour of the surface temperatures of wires and pipe of a heat exchanger 6 on its path through the furnaces 7 and 9. The heating begins at time t=0 when the heat exchanger enters the pre-heating furnace 7. The temperature in its interior is 240° C.; the temperature of the wires 2 shown by a curve 16 approaches this value more rapidly than the temperature of the pipe 1 shown by a curve 17. During the residence time of the heat exchanger 6 in the pre-heating furnace 7 neither the wires nor the pipe reach the air temperature of the pre-heating furnace; the temperature of the wires is almost equalised after 60 s at about 220° C.; the temperature of the pipe is significantly lower at about 170° C.

At time t=60 s the heat exchanger 6 is brought into the rapid heating furnace 9 where it is exposed to a temperature of 420° C. When at time t=90 s the heat exchanger is removed from the rapid heating furnace 9 and transported further to the fluidised bed 11, the wires have reached a temperature of just above 400° C.; the surface temperature of the pipe is about 330° C. Between the surface of the pipe and its interior there is a temperature difference of 10 to 15° C. This means that surface areas of the pipe which are directly adjacent to a joining point 3 to a wire 2 and which are thus only comparatively less efficiently heated by contact with hot gas in the furnaces 5 and 7, have reached a temperature of the same order of magnitude. Thus, unlike in the conventional case of rapid heating, they are not strongly cooled in a single step by heat removal into the interior of the pipe but substantially by the pipe delivering heat to the fluidised bed in which it is immersed. This cooling does not take place more rapidly at the contact points 3 between wire 2 and pipe 1 than at other areas of the pipe. Rather, at problematical points during coating such as the narrow gaps 4 in the contact area between wire and pipe the heat release to the fluidised bed is slower than at the exposed surface areas of the pipe as a result of the protected position of these points so that it can be expected that a temperature sufficient to melt the coating material will persist longer at these points than at other locations whereby the difficult access of the coating material to these points is compensated and a layer having uniform thickness and high quality is also obtained at these problem points.

The invention claimed is:

1. A method for sinter coating a work-piece formed from at least two sections having different surface-related heat capacities, comprising:

pre-heating the work-piece under conditions which would, if continued, bring the work-piece to a first temperature which is above a fusion temperature of a sinter coating material to be applied to the work-piece;

heating the work-piece under conditions which would, if continued, bring the work-piece to a second temperature which is above the first temperature, wherein during the heating step a rate of temperature change of the work-piece is greater than the rate of temperature change which occurs during the pre-heating step;

stopping said heating step after the temperature of the section with the greater surface-related heat capacity is above the fusion temperature of the sinter coating material, but before the temperature of the section with the greater surface-related heat capacity matches said second temperature; and applying the sinter coating material to said work-piece after the heating step has been stopped and while the temperature of the section with the greater surface-related heat capacity remains above the fusion temperature of the sinter coating material.

2. The method according to claim 1, wherein the heating step comprises inserting said work-piece into a first thermal bath substantially at said second temperature.

3. The method according to claim 2, wherein the pre-heating step comprises inserting said work-piece into a second thermal bath substantially at said first temperature.

4. The method according to claim 3, including the residence time of said work-piece in said second thermal bath is longer than the residence time of said work-piece in said first thermal bath.

5. The method according to claim 1, further comprising heating at least the surface of said work-piece to at least the fusion temperature of said sinter coating material after the applying step has been performed.

6. The method according to claim 1, including said step of applying of said sinter material is accomplished by introducing said heated work-piece into a body of fluidised sinter material.

7. The method according to claim 1, including said sinter material is a polyamide powder.

8. The method according to claim 3, including said temperature of said second thermal bath is between 200 and 340° C.

9. The method according to claim 8, including said temperature of said first thermal bath is between 390 and 420° C.

10. The method according to claim 9, wherein the heating step is stopped when said section having said higher surface-related heat capacity has reached an average temperature in a range between 300 and 370° C.

11. The method according claim 1, including said work-piece is a heat exchanger, said section having said higher surface-related heat capacity is a pipe and said section having said lower surface-related heat capacity is a plurality of wires affixed to said pipe.

12. The method according to claim 11, including said heat exchanger is a condenser for a refrigerator.

13. The method according to claim 1, wherein the pre-heating step is stopped before the temperature of the work-piece reaches the first temperature.

14. The method according to claim 13, wherein the pre-heating step is performed such that when the pre-heating step is completed, a temperature of the section of the work-piece with the greater surface-related heat capacity is lower than a temperature of the section of the work-piece with the lower surface-related heat capacity.

15. The method according to claim 1, wherein the pre-heating step is performed such that when the pre-heating step is completed, a temperature of the section of the work-piece with the greater surface-related heat capacity is lower than a temperature of the section of the work-piece with the lower surface-related heat capacity.

16. A device for sinter coating a work-piece formed from at least two sections having different surface-related heat capacities, comprising;

a conveying section for conveying the work-piece to be coated;

a pre-heating furnace arranged along the conveying section for pre-heating the work-piece, wherein the pre-heating furnace is maintained at a first temperature between 200 and 340° C.;

at least one heating furnace arranged after the pre-heating furnace along the conveying section for heating the work-piece such that a rate of temperature change of the work-piece in the heating furnace is greater than a rate of temperature change of the work-piece in the pre-heating furnace, wherein the heating furnace is maintained at a second temperature of between 390 and 420° C., and wherein a conveying speed of the conveying section results in the work-piece being carried out of the heating furnace before the temperature of the section with the greater surface-related heat capacity matches said second temperature; and a fluidised bed for applying the sinter coating material to said work-piece as said conveying section conveys said work-piece through said fluidised bed.

17. The device according to claim 16, wherein a length of the pre-heating furnace along said conveying section is greater than a length of the heating furnace along said conveying section.

18. The device according to claim 16, further comprising an after-heating furnace arranged after the fluidized bed along the conveying section for heating a surface of the work-piece to a temperature greater than approximately 170° C.

* * * * *